United States Patent [19]

Singer et al.

[11] Patent Number: 4,744,521

[45] Date of Patent: May 17, 1988

[54] FLUID FOOD PROCESSOR

[75] Inventors: Norman S. Singer; Shoji Yamamoto; Joseph Latella, all of London, Canada

[73] Assignee: John Labatt Limited, London, Canada

[21] Appl. No.: 606,978

[22] Filed: May 4, 1984

[51] Int. Cl.[4] ..... B02C 4/10

[52] U.S. Cl. ..... 241/66; 241/244

[58] Field of Search ..... 241/65–67, 241/244, 228, 261.1, 251, 252, 253, 254, 46.15, 46.06, 30

[56] References Cited

U.S. PATENT DOCUMENTS

| | | | |
|---|---|---|---|
| 382,364 | 5/1888 | Jamieson | 241/251 |
| 1,428,687 | 9/1922 | Ferencz | 241/228 X |
| 1,679,093 | 7/1928 | Miller et al. | 241/30 X |
| 1,717,126 | 6/1929 | State . | |
| 1,725,155 | 8/1929 | McAllister . | |
| 1,851,071 | 3/1932 | Travis . | |
| 1,997,032 | 4/1935 | Alstad et al. . | |
| 2,023,607 | 12/1935 | Miller . | |
| 2,171,465 | 8/1939 | Weidlich . | |
| 2,212,662 | 8/1940 | Hennessy . | |
| 2,231,421 | 2/1941 | Gitzendanner | 241/261.1 X |
| 2,474,006 | 6/1949 | Maycock . | |
| 2,474,007 | 6/1949 | Maycock . | |
| 2,552,889 | 5/1951 | Eaton | 241/46.06 X |
| 2,745,261 | 5/1956 | Merrill . | |
| 3,164,328 | 1/1965 | Van Dornick | 241/46.15 X |
| 3,331,560 | 7/1967 | Hodgson et al. | 241/244 X |
| 3,367,126 | 2/1968 | Howell . | |
| 3,570,775 | 3/1971 | Stavely | 241/244 |
| 3,742,724 | 7/1973 | Carpigiani . | |
| 3,781,132 | 12/1973 | Latinen . | |
| 3,788,567 | 1/1974 | Yamada | 241/261.1 X |
| 3,910,346 | 10/1975 | ter Braak . | |
| 3,935,808 | 2/1976 | Mendoza . | |
| 4,198,383 | 4/1980 | Konsetov et al. . | |
| 4,398,830 | 8/1983 | Koerfer . | |
| 4,416,548 | 11/1983 | Carre et al. . | |

OTHER PUBLICATIONS

Day, R. H., The Role Of Scraped Surface Heat Exchangers In the Food Industry, Food Trade Review, 4–1970.

An Advertisement Entitled, "The Versatile Artisan Rototherm As A Heat Exchanger".

*Primary Examiner*—Mark Rosenbaum

*Attorney, Agent, or Firm*—Fisher, Christen & Sabol

[57] ABSTRACT

The present invention relates to a fluid processing apparatus particularly useful for processing fluid foods in a highly uniform, "non-statistical" manner at controlled temperatures and high shear rates. The apparatus comprises a first means including an essentially smooth and unencumbered concave cylindrical surface of constant radius; a second means including an essentially smooth and unencumbered convex cylindrical surface having a constant radius which is less than, but not more than about 2 mm less than, the constant radius of said first means; said first and second means being arranged in mutually concentric relation with one another and such that there is a uniform annular treatment zone consisting of the gap formed between said first and second means, said treatment zone being arranged in heat transfer relation with a source of heat transfer medium; and, a third means for providing relative rotary motion between said first and second means, about the common longitudinal axis of symmetry thereof.

22 Claims, 3 Drawing Sheets

FLUID FOOD PROCESSOR

The present invention relates to the processing of food and, in particular, a device for processing fluid foods.

BACKGROUND

The food industry utilizes a large variety of treatments in the production of the many and diverse food products now available. Such treatments process food into the different forms and types of food products expected by the present-day consumer and also convert food into non-perishable forms, the latter requirement being well appreciated as highly desirable even by primitive man. As far as fluid foods are concerned, widely used treatments include simple mixing; emulsifying; homogenizing; comminuting; heating/cooling, and so on, and many types of devices are available for carrying out such treatments.

For example, fluid foods (or other fluid substrates) required to be emulsified, such as salad dressings, can be processed in equipment which include simple agitators utilizing mechanically-rotatable paddles or other mixing devices which provide more severe treatment, such as turbine agitators, where fixed baffles are located on the tank wall or, as in a turbine rotor and stator assembly, adjacent the propellers. The well known colloid mill is widely used to convert two or more fluids into an emulsion having a uniform droplet or particle size due to the fixed small clearance between the rotor and stator. In some instances external cooling may be provided to remove heat generated by the relatively high shearing forces applied to the emulsion. Another high shear mixing device is the homogenizer which operates by forcing the phases being processed past a spring-seated valve. However, such a treatment can result in the fine particles uncontrollably clumping up and the so called "bunches of grapes" thereby produced must then be separated by passing the fluid substrate through a second stage of the homogenizer. It will be appreciated therefore that in such circumstances the use of homogenizer apparatus necessarily entails a two-stage treatment process.

Turning to heat transfer treatments: many devices are used for this purpose including the many forms of heat exchangers which have been used for many years such as plate and falling film devices as well as the more recently developed scraped surface heat exchangers. The latter devices are widely used in the food industry, refer for example to the review article entitled "The Role of Scraped Surface Heat Exchangers in the Food Industry" by R. H. Ray in the April 1970 issue of *Food Trade Review.* Such devices provide a relatively large treatment zone (about 60 mm or more, depending on the size of the device) through which the product is passed, this zone being formed between the inner surface of a heat exchange tube and a rotatable shaft located within that tube. The shaft carries a number of generally radially extending scraper blades which, when the unit is in operation, continuously scrape product being processed from the inner surface in order to minimize burning on, scaling or crystalization of product on the heat exchange surface(s). Moreover the turbulent passage of the blades through the product as they are rotated about the shaft provides for some mixing of the product in order to enhance the uniformity of the treatment to which the mass of product as a whole is exposed. This type of processing is known in the engineering arts as "statistical" processing. This term is used to describe processing conditions (such as product temperature gradient, for example) which are not maintained uniformly throughout the treatment zone. Accordingly, continuous mixing of the product is made necessary in order to ensure statistically that all of the product is brought into that region of the treatment zone wherein the desired processing conditions are manifest under the given operating conditions of the specific device for the particular product in question, i.e., the "active processing zone". Clearly, only a fraction of the product contained within the treatment zone is in the active processing zone and therefore at any given moment in time subject to the intended processing conditions. The treatment of that product mass as a whole, therefore, is carried out by moving (by mixing) already treated product out of the active processing zone within the treatment zone and replacing it with untreated product from outside of that zone. The processing is therefore "statistical" in nature since the exchange of untreated for treated product in the active processing zone is largely random. Equally clear is the fact that as the time during which a given sample of product is resident within the treatment zone increases, so also does the percentage of the product in that sample which has been treated. Given the random effect of the product mixing in the treatment zone, the probability that treated product will be replaced by already treated product in the intended processing zone, also increases with time. The effect of such processing is to place a theoretical lower limit on the variance about an "ideally treated product" mean beyond which the uniformity of the product treatment cannot be improved.

In practice even that theoretical limit cannot be approached since other product flow patterns and especially eddy currents generated by the blade support struts, mean that even product residence time within the treatment zone will not be uniform. In many instances, this variation in the treatment to which product is subjected is not commercially significant in the effects that it has on the product. In other instances, however, such as where fluid containing proteinaceous materials (colloids in particular) are to be treated, the variation can be detrimental to the commercial acceptability of the resulting product. The annular space must obviously be wide enough to accommodate the scraper blades and is 60 mm or more depending on the size of the device, the active processing zone being significantly smaller than that size.

It remains only to be noted that commercially available scraped surface heat exchangers are generally designed to operate continuously at shaft rotational speeds of about 250 rpm to 300 rpm, and exceptionally up to about 500 rpm. Such devices therefore provide efficient mixing and heat transfer but only relatively moderate levels of shear.

SUMMARY OF THE INVENTION

It has been found that when it is necessary or desirable to subject a food product (or other substrate) in fluid form to high shear and, simultaneously, rapidly raise the temperature thereof in a controlled manner, the known devices have proved unsuitable. Moreover, any two such devices, each affording one of the processing treatments, i.e. either high shear or rapid heating are *prima facie* incompatible on a large scale. The Applicants therefore were forced to design a processor which would meet the above requirements. In accordance, therefore, with one aspect of the present invention, there is provided an apparatus suitable for uniform, non-statistical processing of a fluid substrate, said apparatus comprising:

a first means including an essentially smooth and unencumbered concave cylindrical surface of constant radius;

a second means including an essentially smooth and unencumbered convex cylindrical surface having a constant radius which is less than, but not more than about 2 mm less than, the constant radius of said first means;

said first and second means being arranged in mutually concentric relation with one another and such that there is a uniform annular treatment zone consisting of the gap formed between said first and second means, said treatment zone being arranged in heat transfer relation with a source of heat transfer medium; and, a third means for providing relative rotary motion between said first and second means, about the common longitudinal axis of symmetry thereof.

In one embodiment this was achieved by providing a device comprising an elongated tube having an inner cylindrical surface and an outer surface, the latter being provided with means to carry a heat exchange medium. An elongated cylindrical rotator is provided within said tube which is concentric with the inner surface and is rotatable about a common axis of the tube and the rotator. Between the inner surface and the rotator there is a annular space having a width of not more than about 2 mm, this constituting the material processing or treatment zone. It has been found that in the device of this invention, provided the material processing zone has a thickness of not more than about 2 mm, the treatment zone is substantially both co-extensive and co-terminous with the active processing zone with the result that the present fluid processor provides for highly uniform treatment (i.e., as distinguished from "statistical" treatment as hereinbefore described) of a fluid substrate. As indicated above, this system not only allows for rapid processing but provides more control, the resulting product having more consistent physical characteristics and properties.

The rotator is arranged to rotate at high speed and the high relative speed between the tube inner surface and the surface of the rotator imparts the desired high shear to material passing through the annular zone. The elongate character of the inner surface, i.e., the heat transfer area, coupled with the thickness of material being greatly restricted to a relatively thin layer totally within the active treatment zone provides rapid heat transfer whereby the temperature of the material being processed is very rapidly raised to the desired elevated levels whilst being subjected to intensive shear. A large volume of substrate may therefore be processed in the very thin layer at elevated temperatures in a very short period of time. This helps to reduce or even avoid the deleterious effects that prolonged heating would have on heat-sensitive materials being processed and, of course, many food components such as proteins are heat-sensitive. Very importantly, the shear assists in controlling the undesirable agglomeration of particles in the material being treated and in effect allows such agglomerating processes to be arrested when desired, a feature not readily available by prior art devices. The substantially instantaneous non-statistical nature of the heat treatment afforded by the present invention greatly narrows the particle size distribution of the material being treated, a highly desirable feature.

For the device to function in the desired manner, it is essential that there be no obstacles to the rapid movement of fluid material through the treatment zone. Consequently, it is most important that the annular space and the surfaces defining same are not encumbered with mechanical obstructions of any type such as, for example, scraper blades or blade support struts.

DETAILED DESCRIPTION OF THE INVENTION

According to another aspect of the present invention there is provided a fluid substrate processor comprising:

a tube including an outer surface and an inner cylindrical surface having a central longitudinal axis;

means on said outer surface to carry a heat exchange medium;

an elongated cylindrical rotator rotatable about said axis, said rotator being located within said tube and oriented coaxially with said inner surface whereby there is provided a treatment.

zone consisting of a substantially uniform unobstructed annular space of not more than about 2 mm between said rotator and said inner surface;

means to rotate said rotator at high speed; and means external of said treatment zone, adapted to fill said treatment zone with a fluid to be treated and thereafter to maintain said zone in a filled condition while providing for the through-put of said fluid substrate during the processing thereof in said treatment zone.

It will be appreciated that the present device provides for extremely rapid treatment of the substrate and to further assist passage of substrate material therethrough, it is preferred that the inner surface of the tube and/or an outer surface of the rotator be coated with, or consist of, a relatively inert polymeric material such as a halogenated polyethylene, e.g., polytetrafluoroethylene or chlorotrifluoroethylene polymer.

Generally a pump system is used to supply material to the treatment zone.

When it is contemplated that any given processor of the present invention will be used to treat fluid substrates under temperature conditions which, at ambient pressures would permit a vapour phase to form within the treatment zone, the provision must be made to prevent such out-gassing. Usually, a supply pump is located upstream of the treatment zone and means, such as a valve, are provided downstream of the treatment zone whereby the pressure within said zone may be controlled. In a preferred arrangement, a first pump located upstream of the treatment zone supplies fluid substrate from a source thereof to said zone and a second pump, located downstream from the treatment zone and operating at a lower rate than the first pump, establishes a back pressure in the treatment zone. Regardless of whether a pump or some other means is used to create this back pressure, the back pressure is generally essential in order to avoid out-gassing in the treatment zone of volatile substrates from the fluid substrate. The formation of a vapour phase in the treatment zone defeats the purpose of the design features intended to promote uniformity of processing conditions within the zone by creating an unstable, often transient and usually only local insulating barrier to the efficient, uniform transfer of heat to the fluid substrate. For this reason it is also preferred that fluid substrates to be treated in the processor of the present invention be deaerated prior to processing. This can be readily accomplished by way of commercially available deaerating apparatus, e.g. the VERSATOR TM deaerator sold by the Cornell Machine Company.

The two pump system mentioned above permits a balanced control over both throughput and back pressure. The first, or upstream, supply pump is adjustable to set the rate of product throughput through the treatment zone. The operation of the second or downstream pump is then adjustable to control the back pressure generated within the apparatus (including the treatment zone) intermediate the two pumps.

The need to avoid the generation of a vapour phase in the treatment zone is doubly important when the fluid substrate is a food product. Loss of volatile components from a food product generally compromises the organoleptic quality of the food although, as will be appreciated by those skilled in the art, the controlled rectification of some undesirable volatile components may actually enhance certain food products. It is possible to control or even avoid loss of volatile components from the fluid substrate by cooling the substrate following completion of the treatment thereof to a temperature below that at which unwanted volatilization or separation occurs at ambient atmospheric pressures prior to decreasing the back pressure to ambient. This is perhaps most readily accomplished by providing a heat exchange device intermediate the treatment zone and the second pump. Other considerations bearing on the temperature at which the product exits the second pump (or other means suitable for establishing the appropriate back pressure) may include, for example, whether or not direct aseptic packaging of the treated product is desired or whether product is to be passed to storage. In any case, the formation of a vapour phase must be substantially avoided within the treatment zone and this is accomplished by providing means in the processor of the present invention for maintaining the contents of the treatment zone under sufficient elevated pressure, relative to ambient atmospheric pressure, to prevent the formation of a vapour phase within the zone which might otherwise result as a consequence of out-gassing of components contained in the substrate at elevated treatment temperatures.

The amount of back pressure is, of course, contingent on the nature of the fluid substrate being treated and the treatment conditions being used for that purpose. The necessary pressures consistent with avoiding out-gassing in the treatment zone is easily calculated and will be readily apparent to a man skilled in the art.

As indicated above, it is essential that the treatment zone has a thickness of less than about 2 mm. Usually this zone is not less than about 0.5 mm. Given the state of the machining arts, thicknesses of less than 0.5 mm can raise problems since, as a practical matter, maintaining such a small gap becomes very difficult bearing in mind the inherent machinery tolerances of the parts, such as the rotator, et cetera. Similarly, bearing wear in the machines could result in seizing up of the rotator in the tube. In any case, it is the narrow treatment zone and the high speed of the rotator which in combination produce the extremely high shear which is required. For example, the pilot plant-size processor (nominal capacity about 100 lbs/hr) described in more detail herein, when running at 900 rpm with a treatment zone thickness of about 1.5 mm, produces a shear value of about 500,000 $sec^{-1}$. It is preferred that the shear used is that generated in that processor when the rotator is running at a rate of from 900 rpm to 1500 rpm, preferably 900 rpm to 1100 rpm and especially about 1000 rpm. The values of shear rate envisaged herein by the term "high shear" will therefore be understood by a man skilled in the art.

The present invention will be further described with reference to, but not limited by, the accompanying drawings in which.

Figure 1:
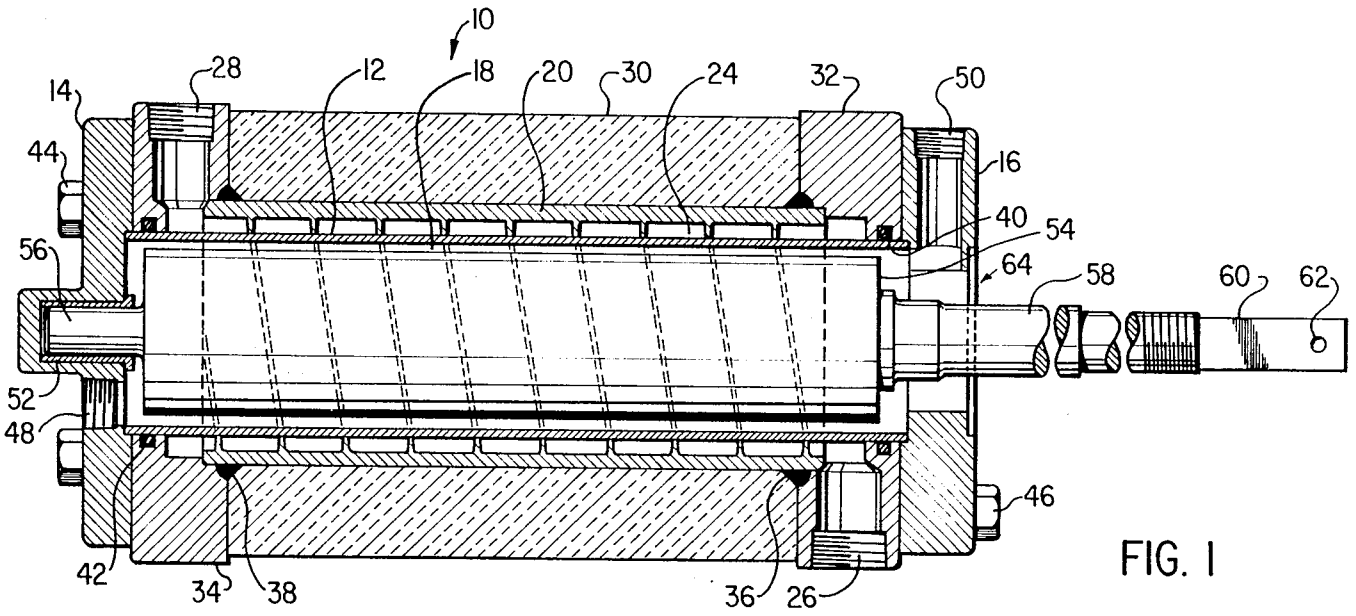
FIG. 1 is a cross-section through a portion of the processor of the present invention.

Turning to FIG. 1, the processor of the present invention generally designated 10 comprises an elongated tube 12, the ends of which are closed by closure plates 14 and 16 thereby providing a chamber 18 which constitutes a processing zone. The tube 12 is enclosed within and is co-axial with a larger elongated tube 20. The annular space between tubes 12 and 20 is converted by molding 22, which extends from the interior surface of tube 20 to the exterior surface of tube 12, into a channel 24 which extends in a helical fashion from heat exchange medium inlet 26 to heat exchange medium outlet 28.

The outer tube 20 is enclosed within a thermal insulating jacket 30 which extends the full length of tube 20 between end members 32 and 34. End members 32 and 34 which contain inlets 26 and 28, respectively, are secured at their axially inner junction by welds 36 and 38, respectively and, to prevent heat exchange medium leaking, are provided with an "O" ring seal arrangement 40 and 42, respectively at their axially outer junction with tube 12. End plate 14 is secured to end member 34 by bolts 44 and plate 16 is secured to end member 32 by bolts 46. Extending through end plate 14 is material exit port 48 and through end plate 16 material inlet port 50. The terms inlet and outlet are herein used interchangeably since, obviously, their functions could be reversed if desired. End plate 14 is formed to carry a conventional bearing assembly 52.

Extending axially through chamber 18 is a rotator 54 made of stainless steel but having fused thereon a coating of polytetrafluorethylene. The diameter of the main body portion of rotator 54 is only slightly less than the internal diameter of tube 12 such that an annular processing zone of about 2 mm in width is provided between rotator 54 and the inner surface of tube 12. A reduced end portion 56 of rotator 54 is supported by the bearing assembly 52 (e.g. bushing in a stainless steel head) carried by plate 14. A reduced end portion 58 of the rotator 54 is also supported for rotation within a conventional bearing arrangement (not shown), for example, a cylindrical cartridge type such as a FAFNIR LC MECHANISEAL TM type.

The extremity 60 of reduced end portion 58 is provided with a flat point socket 62. The opening 64 of chamber 18 is sealed with a conventional closure plate arrangement 74 (refer to FIG. 1A).

Figure 1A:
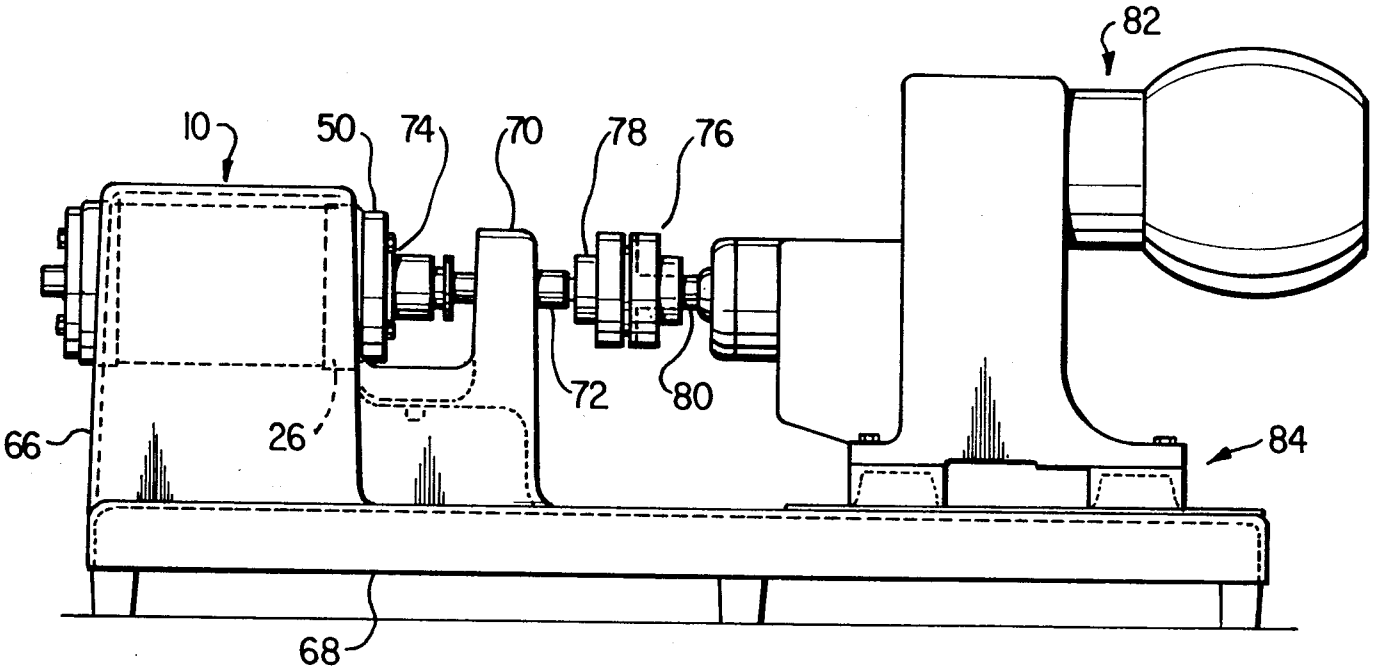
FIG. 1A is a side elevation of the processor unit as depicted in FIG. 1 in combination with its associated drive system.

Turning to FIG. 1A, this shows the food processor 10 carried by housing 66 which in turn is mounted on base 68. The processor shown is an experimental model having an internal diameter of about 3 inches (about 7.6 cm) which results in a treatment zone (i.e., defined as the area of the inner wall of tube 12 opposing the main body of rotator 54 of a nominal square foot (i.e. about 930 $cm^2$) which is reduced in practice due to the presence of seals, end plates, et cetera, to a working area of about 650 $cm^2$. The device is adapted for use with steam, water or brine as the heat transfer medium allowing for a very wide range of processing temperatures. Allowable pressures within the processor depend on the seals used but even with conventional seals using rubber components, these can be quite high, for example, 50 to 100 psi. The cylindrical cartridge-type bearing assembly is mounted within support 70, held in place by nut 72. The closure plate arrangement of chamber 18 is shown at 74. Extremity 60 of shaft 58 connects with a flexible coupling 76, for example, a LOVEJOY TM flexible coupling, a shear pin (not shown being located in a socket located at 78). Also connected to coupling 76 via shaft 80 is a variable speed motor 82 which is carried by support 84 mounted on base 68. The motor and associated gearing is adapted to rotate the rotator 54 at speeds of up to 1500 rpm.

Figure 2:
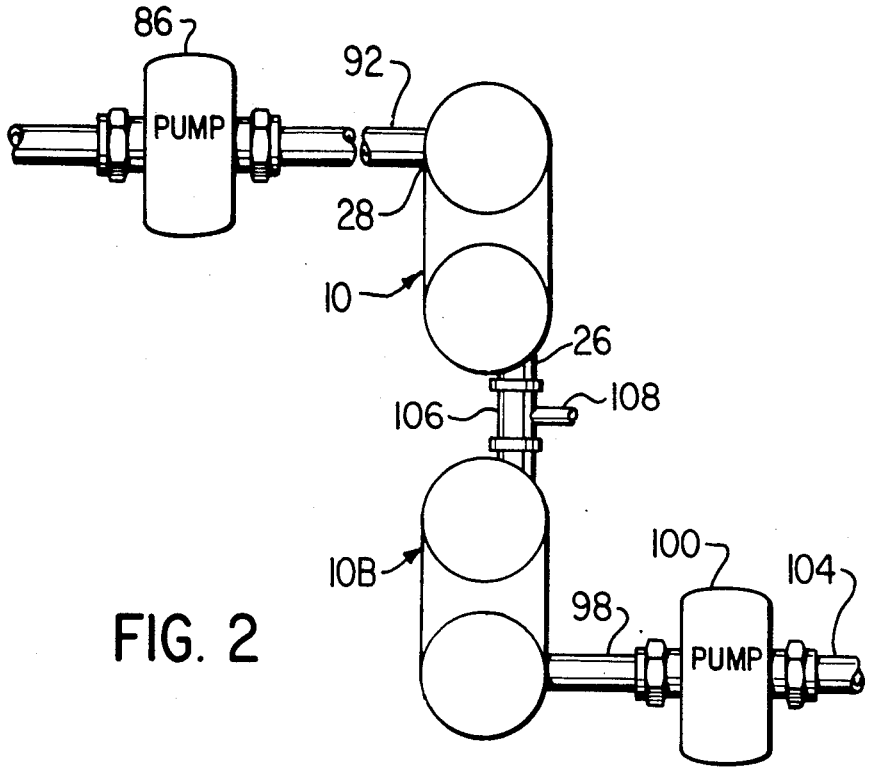
FIG. 2 is a diagrammatic layout of a pilot plant system incorporating the processor system of the present invention arranged in tandem with a scraped surface heat exchanger.
Figure 2A:
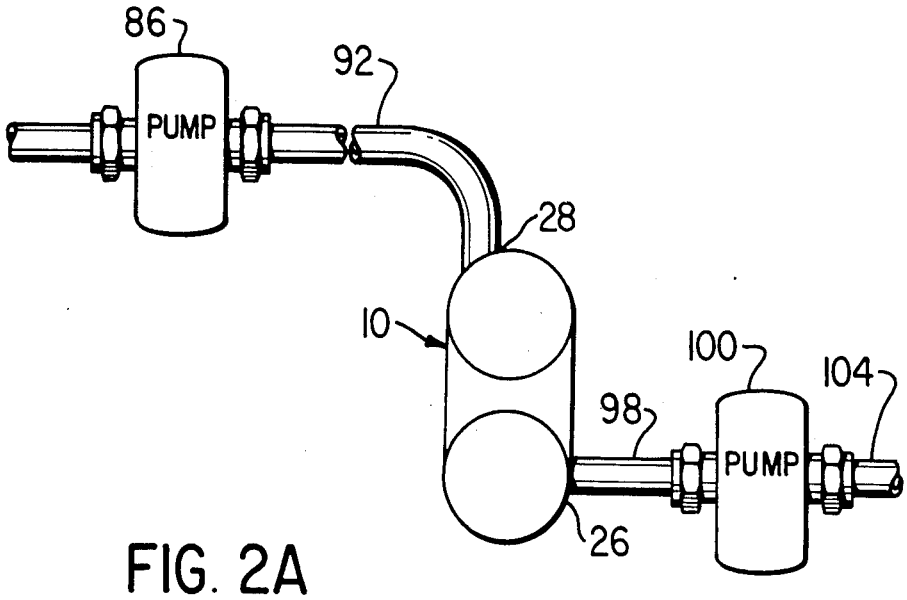
FIG. 2A is a diagrammatic layout of a simple pilot plant system incorporating a processor unit and associated pump system of the present invention.

Turning now to FIG. 2A, there is illustrated the food processor 10 of the present invention and a pump system arranged to supply material to, maintain the pressure in, and extract processed material from processor 10. The pump system comprises a first pump 86 connected via conduit 92 to the inlet 28 of processor 10. The exit port 26 of processor 10 communicates with conduit 98 and a second pump 100. Processed material exits pump 100 via conduit 104.

The plant depicted in FIG. 2 preferably comprises a processor of the present invention shown in FIG. 2A arranged in tandem with a conventional scraped surface heat exchanger, the remainder of the system remaining exactly as shown in FIG. 2A. The axially oriented exit port 26 of the processor 10 is connected via conduit 106 to the equivalent axially oriented port of the conventional scraped surface heat exchanger 10B. As will be clear from the drawing, that mode of connection ensures a smooth flow of material, without change of direction, through both the processor 10 and the conventional heat exchanger 10B. This ensures an even flow of product from the processor 10 to the heat exchanger 10B wherein the product is cooled as aforementioned to avoid loss of desirable volatile components. Also, by avoiding eddy currents in the flow between the processor 10 and heat exchanger 10B, none of the product remains at the elevated treatment temperature for an undesirably protracted period, which in turn assists in maintaining the uniform character of the product.

It is contemplated that a second processing unit of the present invention could be utilized in place of the conventional scraped heat exchanger 10B. This latter arrangement, in effect, provides a processor having a processing zone consisting of two partial zones in tandem with one another and in which the conditions of temperature and shear can be independently adjusted. For example, both zones could be operated in exactly the same manner thereby providing, in effect, one treatment zone giving twice the residence time for the material being treated. On the other hand, one zone could be operated to heat material whilst the other could be operated to cool the material, either rapidly or slowly as may be desired. The flexibility this arrangement provides will be self-evident. Of course, more than two processors could be connected in this manner.

The connecting conduit 106 is provided with an insulating jacket or preferably for flexibility of operation, means to attain the passage of a heat exchange medium therearound. It is also provided with a port 108 through which temperature and pressure sensors (not shown) are located, thereby allowing careful monitoring of the states of material during processing.

Heat exchange medium is circulated through helical chamber 24 usually in a countercurrent manner to that of material being processed. For example, material to be processed would usually enter through radially oriented inlet port 50 and exit via axially oriented port 48, in which case heat exchange medium would enter chamber 24 via port 28 and exit via port 26.

In operation, the fluid food, slurry or solution to be processed is supplied to pump 86 and is introduced to processor 10 via conduit 92 at a substantially constant rate.

In the meanwhile, the rotator 54 is driven at a constant speed in the range of between 750 and 1500 rpm; usually 850 to 1200 rpm. Processed material exits via port 48, passes through conduit 98 to pump 100 and finally, to packaging equipment if it is to be packed immediately. This arrangement and operation is very advantageous since, for example, reheating of the product to sterilize same, et cetera, need not be carried out. Alternatively, the processed material can be passed to storage. It should be noticed that pumps 86 and 100 work together in an arrangement which ensures smooth transport of material through the processor and also allows for delicate fine tuning of the pressure in the system. Obviously, upon start up, the system has to be balanced to obtain precisely the pressures, temperatures, shear applied and rate of material throughput desired, those parameters obviously being mutually interdependent to a great extent.

In the preferred embodiment of the system as shown in FIG. 2, the processor 10 and conventional scraped heat exchanger 10B (which is also a food processor in this context) are arranged in tandem by conduit 106. In effect, this arrangement constitutes a processor like that shown in FIG. 1 but further providing a second heat exchange zone which can be adjusted so as to efficiently cool the product passing through the system.

That latter system has proved most useful in processing a fluid whey substrate so as to produce the Protein Product Base described in the present Applicant's copending application Ser. No. 606,959, filed simultaneously herewith. In that instance, the temperature of the heat transfer medium being introduced to the inlet 26 of the first processor was about 120 degrees Centigrade, and the product was treated to about 500,000 $sec.^{-1}$ of shear (generated by a shaft speed of about 900 rpm at a zone width of about 2 mm). The conventional scraped heat exchanger was operated such that product being processed therein was cooled to a temperature of about 80 degrees Centigrade. In this way, the processed material was cooled in a controlled manner from its maximum temperature at processing to a reduced temperature which allowed the product to be aseptically packed directly, without further treatment, into aseptic bottles. The residence time in the first processor ranged between about 3 to 8 seconds in total. The pressure of the product within the processor 10 was from about 80 psi to about 90 psi. As will be appreciated, the pressure which need be maintained in the processor will depend, inter alia, on the volatility of components in the substrate being treated and the treatment temperature being employed. These pressures may be as high as 100 psi or more where necessary or desirable, provided however, that the bearings, seals and other components of the processor system are designed to accommodate such pressures.

What we claim is:

1. A fluid substrate processor comprising:

a tube including an outer surface and an inner cylindrical surface having a central longitudinal axis;

means on said outer surface to carry a heat exchange medium;

an elongated cylindrical rotator rotatable about said central longitudinal axis of said tube, said rotator having a smooth surface and being located within said tube and oriented coaxially with said inner surface whereby there is provided a treatment zone consisting of a substantially unobstructed annular space of a uniform cross-sectional area, said annular space being not more than about 2 mm between said smooth surface of said rotator and said inner cylindrical surface of said tube;

means to rotate said rotator at high speed;

means external of said treatment zone, adapted to fill said treatment zone with a fluid substrate to be treated and thereafter to maintain said zone in a filled condition while providing for the throughput of said fluid substrate during the processing thereof through said treatment zone; and a means to maintain said zone at sufficiently elevated pressure relative to ambient atmospheric pressure to prevent the formation of a vapour phase within said zone which might otherwise result as a consequence of out-gassing of components contained in said fluid substrate at elevated treatment temperatures.

2. The processor of claim 1 wherein said means for introducing the fluid substrate into said zone is pump means.

3. The processor of claim 2 wherein said pump means consists of two pumps, one arranged to supply the fluid substrate to said inlet and one arranged to receive product from said outlet.

4. The processor of claims 1 or 4 wherein at least one of a surface of the tube inner surface and the smooth surface of the rotator are comprised of a halogenated, hydrocarbon polymer.

5. The processor of claims 1 or 4 wherein said rotator is adapted to rotate at speeds in excess of 750 rpm.

6. The processor of claims 1 or 4 wherein said rotator is adapted to rotate at speeds in excess of 850 rpm.

7. The processor of claims 1 or 4 wherein said rotator is adapted to rotate at speeds greater than 850 rpm but less than 1500 rpm.

8. The processor of claims 1 or 2 wherein said rotator is adapted to rotate at speeds of greater than 850 rpm but less than 1200 rpm.

9. The process of claim 8 wherein additional heat exchange means is provided intermediate said treatment zone and a second pump means.

10. The processor of claim 2 wherein means for maintaining said elevated pressure comprises a second pump means.

11. A fluid protein substrate processor comprising:

a tube including an outer surface and an inner cylindrical surface having a central longitudinal axis;

a means on said outer surface for carrying a heat exchange medium;

an elongated cylindrical rotator rotatable about said central longitudinal axis of said tube, said rotator having a smooth surface and being located within said tube and oriented coaxially with said inner surface of said tube;

a treatment zone between said smooth surface of said rotator and said inner surface of said tube, said treatment zone being substantially unobstructed and having a uniform cross-sectional area between said smooth surface of said rotator and said inner surface of said tube of up to about 2 mm;

a means for rotating said rotator at high speed;

a means external of said treatment zone for filling said treatment zone with fluid protein substrate, said treatment zone being maintained in a filled condition with said fluid protein substrated as said fluid protein substrate is transported through said treatment zone, said fluid protein substrate being heat denatured in said treatment zone and being transformed by said rotation of said rotator into a colloid substantially free of agglomeration; and a means to maintain said zone at sufficiently elevated pressure relative to ambient atmospheric pressure to prevent the formation of a vapor phase within said zone which might otherwise result as a consequence of out-gassing of components contained in said fluid protein substrate at elevated treatment temperatures.

12. The processor of claim 11 wherein said means for introducing the fluid protein substrate into said zone is pump means.

13. The processor of claim 12 wherein said pump means consists of two pumps, one arranged to supply fluid protein substrate to said inlet and one arranged to receive product from said outlet.

14. The processor of claim 11 or 12 wherein at least one of a surface of the tube inner surface and the surface of the rotator are comprised of a halogenated, hydrocarbon polymer.

15. The processor of claim 11 or 12 wherein said rotator is adapted to rotate at speeds in excess of 750 rpm.

16. The processor of claim 11 or 12 wherein said rotator is adapted to rotate at speeds in excess of 850 rpm.

17. The processor of claim 11 or 12 wherein said rotator is adapted to rotate at speeds between about 850 rpm and about 1500 rpm.

18. The processor of claim 11 or 12 wherein said rotator is adapted to rotate at speeds of between about 850 rpm and about 1200 rpm.

19. The processor of claim 18 wherein additional heat exchange means is provided intermediate said treatment zone and a second pump means.

20. The processor of claim 12 wherein means for maintaining said elevated pressure comprises a second pump means.

21. An apparatus for uniform, non-statistical processing, said apparatus comprising:

a first means including an essentially smooth concave cylindrical surface of constant radius, said first means having a means for heating exterior to said cylindrical surface, said means for heating adapted to carry a heat exchange medium;

a second means including an essentially smooth convex cylindrical surface having a constant radius, said constant radius being about 2 mm less than said constant radius of said first means;

said first and said second means being arranged in mutually coaxial concentric relation with one another whereby an annular treatment zone is formed between said first and said second means, said treatment zone being arranged in heat transfer relation with said heat transfer medium;

a third means for pumping, said means for pumping being external of said treatment zone and adapted to pump a fluid substrate to be treated through said treatment zone and to maintain said treatment zone in a filled condition with said substrate at a sufficiently elevated pressure relative to ambient atmospheric pressure to prevent the formation of a vapor phase within said treatment zone at an elevated treatment temperature; and a fourth means for providing relative rotary motion between a longitudinal axis of said first and said second means at a velocity sufficient to exert high shear on said fluid substrate during said treatment in said zone.

22. The apparatus of claim 21, wherein said annular treatment zone formed between said first and said second means is uniform both radially and longitudinally.

* * * * *